US011140965B2

(12) United States Patent
Lee

(10) Patent No.: US 11,140,965 B2
(45) Date of Patent: Oct. 12, 2021

(54) AIRTIGHT LIP COSMETIC CASE OF WHICH INSIDE IS DOUBLY SEALED

(71) Applicants: PUM-TECH KOREA CO., LTD, Incheon (KR); CTK CO., LTD, Seongnam-si (KR)

(72) Inventor: Do Hoon Lee, Incheon (KR)

(73) Assignees: PUM-TECH KOREA CO., LTD, Incheon (KR); CTK CO., LTD, Seongnam (KR)

( * ) Notice: Subject to any disclaimer, the term of this patent is extended or adjusted under 35 U.S.C. 154(b) by 0 days.

(21) Appl. No.: 16/334,325

(22) PCT Filed: Sep. 20, 2017

(86) PCT No.: PCT/KR2017/010343
§ 371 (c)(1),
(2) Date: Mar. 18, 2019

(87) PCT Pub. No.: WO2018/056699
PCT Pub. Date: Mar. 29, 2018

(65) Prior Publication Data

US 2020/0022479 A1 Jan. 23, 2020

(30) Foreign Application Priority Data

Sep. 22, 2016 (KR) ..... 10-2016-0121224

(51) Int. Cl.
*A45D 40/06* (2006.01)
*A45D 40/00* (2006.01)

(52) U.S. Cl.
CPC ..... *A45D 40/06* (2013.01); *A45D 2040/0025* (2013.01); *A45D 2200/051* (2013.01)

(58) Field of Classification Search
CPC ..... A45D 40/04; A45D 40/06; A45D 2040/0025; A45D 2200/051; B65D 53/02; F16J 15/3204; F16J 15/3224; F16L 17/035
See application file for complete search history.

(56) References Cited

U.S. PATENT DOCUMENTS 3,028,165 A * 4/1962 Collins ..... F16J 15/32 277/529
3,173,694 A * 3/1965 Nathan ..... F16L 17/035 277/314

(Continued)

FOREIGN PATENT DOCUMENTS

JP 2000-60637 A 2/2000
JP 3499041 B2 2/2004

(Continued)

*Primary Examiner* — David P Angwin
*Assistant Examiner* — Bradley S Oliver
(74) *Attorney, Agent, or Firm* — Heedong Chae; Lucem, PC

(57) ABSTRACT

The present invention relates to an airtight lip cosmetic case of which the inside is doubly sealed, comprising: a lower case; an upper case which is rotatably coupled to the top of the lower case and has a sealing shoulder formed on the outside thereof; a rising piston which rises within the upper case and has a lip cosmetic product attached to the upper side thereof; a sealing piston which is fixed and coupled to the outside of the rising piston; and an over-cap which is detachable from the lower case, wherein the airtight lip cosmetic case further comprises a sealing ring formed on the outer circumference of the rising piston such that the sealing ring rises in a state of being in close contact with the inner circumference of the upper case, and a sealing blade formed on the outer circumference of the sealing piston.

5 Claims, 9 Drawing Sheets

(56) References Cited

U.S. PATENT DOCUMENTS

| | | | | | |
|---|---|---|---|---|---|
| 4,162,079 | A * | 7/1979 | Jelinek | E21B 33/126 | 277/335 |
| 5,085,352 | A * | 2/1992 | Sasaki | A45D 40/04 | 222/327 |
| 5,868,510 | A * | 2/1999 | Lacout | A45D 40/04 | 401/175 |
| 5,879,095 | A * | 3/1999 | Gueret | A45D 40/04 | 401/172 |
| 5,888,004 | A * | 3/1999 | Bouix | A45D 40/04 | 401/87 |
| 7,052,198 | B2 * | 5/2006 | Sasaki | A45D 40/20 | 401/75 |
| 7,938,591 | B2 * | 5/2011 | Kokai | A45D 40/04 | 401/75 |
| 8,439,368 | B2 * | 5/2013 | Peddle | B65D 53/02 | 277/637 |
| 9,474,348 | B2 * | 10/2016 | Tani | A45D 40/04 | |
| 9,532,635 | B2 * | 1/2017 | Tani | A45D 40/12 | |
| 2011/0194884 | A1 * | 8/2011 | Kim | A45D 40/04 | 401/68 |
| 2019/0029398 | A1 * | 1/2019 | Zhang | A45D 40/00 | |
| 2019/0328110 | A1 * | 10/2019 | Lee | A45D 40/06 | |

FOREIGN PATENT DOCUMENTS

| | | | |
|---|---|---|---|
| JP | 5325593 | B2 | 10/2013 |
| KR | 10-1997-0002539 | B1 | 3/1997 |
| KR | 20-0362401 | Y1 | 9/2004 |

* cited by examiner

--PRIOR ART--

AIRTIGHT LIP COSMETIC CASE OF WHICH INSIDE IS DOUBLY SEALED

CROSS-REFERENCE TO RELATED APPLICATIONS

This application is based on and claims the benefit of priority to Korean Patent Application No. 10-2016-0121224 filed on Sep. 22, 2016, with the Korean Intellectual Property Office, the disclosure of which is incorporated herein by reference.

TECHNICAL FIELD

The present invention relates to an airtight lip cosmetic case of which an inside is doubly sealed, and more particularly, to an airtight lip cosmetic case of which an inside is doubly sealed, the airtight lip cosmetic case including: a lower case; an upper case rotatably coupled to an upper portion of the lower case and formed on an outer side thereof with a sealing shoulder; a rising piston configured to rise within the upper case and having a lip cosmetic product attached to an upper side of the rising piston; a sealing piston fixedly coupled to an outer side of the rising piston; and an over-cap detachably attached to the lower case, wherein the rising piston is provided on an outer circumference thereof with a sealing ring such that the rising piston rises in a state in which the sealing ring comes into tight contact with an inner circumference of the upper case, and a sealing blade is formed on an outer circumference of the sealing piston such that the sealing blade comes into tight contact with an inner circumference of the sealing shoulder of the upper case, so that the inside of the lip cosmetic case is doubly sealed by the rising piston and the sealing piston, and thus sealing capability is improved.

BACKGROUND ART

Color cosmetics are used to beautifully adorn the skin by making the appearance beautiful.

The color cosmetics are classified into a base makeup used for making a skin color uniform and covering a defect and a point makeup used for partially enhancing a three-dimensional effect of lips, eyes, or nails. The base makeup includes a makeup base, a foundation, and a powder, and the point makeup includes a lipstick, an eye liner, and a mascara.

Among various cosmetics necessary for color makeup of a woman, the lipstick is used to perform makeup to protect lips and make the lips more beautiful. In a conventional lipstick, a cosmetic composition having various colors is manufactured in the form of a stick to protrude from or to be inserted into a lipstick cosmetic container while ascending and descending within the lipstick cosmetic container.

In other words, the conventional lipstick cosmetic container as described above includes: a case for maintaining appearance of the cosmetic container; a lipstick holder screwed inside the case to ascend and descend along a screw thread by a rotation operation of the case, and mounted thereon with a stick-type cosmetic product; a protection tube installed between the case and the lipstick holder while being partially exposed to an outside to protect the cosmetic product while guiding a vertical movement of the lipstick holder; a fastening cap fastened to an upper portion of the case to securely fix the protection tube; and an over-cap for opening and closing the case.

However, according to the conventional lipstick cosmetic container, since sealing capability is degraded due to the weak coupling between the over-cap and the case, between the case and the lipstick holder, and between the case and the protection tube, external air is introduced into the case during use, so that a lipstick cosmetic product deteriorates or hardens due to the constant contact with the external air.

To solve the problems described above, as shown in FIG. 1, Korean Patent Application Publication No. 20-2015-0004424 discloses a sealing structure of a lipstick cosmetic container. The lipstick cosmetic container according to the above related art includes: a cylindrical container body; a protection tube and a cosmetic holder fastened to each other by a fastening cap; and a stick-type cosmetic product provided on the cosmetic holder to appear and disappear from an outside by a rotation operation of the container body while the cosmetic holder is guided by the protection tube, wherein an inlet of the protection tube is sealed, so that external air is prevented from being introduced.

However, according to the related art, since a sealing structure is not provided between the protection tube, the cosmetic holder, and the fastening cap, the external air is introduced between the protection tube and the cosmetic holder or between the cosmetic holder and the fastening cap, so that an inside of the lipstick cosmetic container is not sealed.

DISCLOSURE

Technical Problem

To solve the problems described above, an object of the present invention is to provide an airtight lip cosmetic case of which an inside is doubly sealed, the airtight lip cosmetic case including: a lower case; an upper case rotatably coupled to an upper portion of the lower case and formed on an outer side thereof with a sealing shoulder; a rising piston configured to rise within the upper case and having a lip cosmetic product attached to an upper side of the rising piston; a sealing piston fixedly coupled to an outer side of the rising piston; and an over-cap detachably attached to the lower case, wherein the rising piston is provided on an outer circumference thereof with a sealing ring such that the rising piston rises in a state in which the sealing ring comes into tight contact with an inner circumference of the upper case, and a sealing blade is formed on an outer circumference of the sealing piston such that the sealing blade comes into tight contact with an inner circumference of the sealing shoulder of the upper case, so that the inside of the lip cosmetic case is doubly sealed by the rising piston and the sealing piston, and thus sealing capability is improved.

In addition, another object of the present invention is to provide an airtight lip cosmetic case of which an inside is doubly sealed, wherein the sealing piston is formed of a soft synthetic resin material, and the sealing blade extends downward from an upper outer circumference of the sealing piston, such that the sealing blade is gradually inclined outward toward a bottom thereof to elastically come into tight contact with the inner circumference of the upper case, so that external air is prevented from being introduced into the upper case, and thus the lip cosmetic product is prevented from deteriorating or hardening due to the external air.

In addition, still another object of the present invention is to provide an airtight lip cosmetic case of which an inside is doubly sealed, wherein a first operation member is installed to be vertically movable at an inner side of the lower case, a second operation member engaged with the first operation member by a sawtooth is coupled to a lower side of the upper case, and an elastic member for elastically pushing up the first operation member is installed at a lower side of the first operation member to allow the first operation member, the second operation member, and the upper case to come into tight contact with each other, so that the sealing capability is maintained while storing or carrying the lip cosmetic case, and thus the lip cosmetic product is prevented from being exposed to the external air.

Technical Solution

According to the present invention, there is provided an airtight lip cosmetic case of which an inside is doubly sealed, in which a lip cosmetic product inside an upper case rises and protrudes when a lower case rotates, the airtight lip cosmetic case comprising:

the upper case rotatably coupled to an upper portion of the lower case;

a rising piston provided in the upper case and having the lip cosmetic product attached to an upper side of the rising piston;

a sealing piston coupled to an inner side of a sealing shoulder of the upper case and having a sealing blade; and an over-cap for opening and closing the upper case, wherein the rising piston rises in a state in which the rising piston comes into tight contact with an inner circumference of the upper case, and the sealing blade of the sealing piston comes into tight contact with an inner circumference of the sealing shoulder of the upper case.

In addition, a first operation member which is vertically movable, a second operation member engaged with an upper portion of the first operation member, and an elastic member for elastically pushing up the first operation member may be further provided and coupled in the lower case.

In addition, the sealing shoulder may be formed on a lower outer circumference of the upper case, in which the sealing shoulder may extend downward from an outer circumference of the upper case while being spaced apart from the outer circumference of the upper case by a predetermined distance.

In addition, the rising piston may be provided on an outer side thereof with a sealing ring.

In addition, the sealing blade may extend downward from an upper outer circumference of the sealing piston, such that the sealing blade is gradually inclined outward toward a bottom thereof to elastically come into tight contact with the inner circumference of the upper case.

In addition, a sealing protrusion wheel may be formed on a lower outer circumference of the sealing blade and may come into tight contact with the inner circumference of the upper case.

In addition, the sealing piston is preferably formed of a soft synthetic resin material.

Advantageous Effects

According to the present invention, the airtight lip cosmetic case of which the inside is doubly sealed includes: a lower case; an upper case rotatably coupled to an upper portion of the lower case and formed on an outer side thereof with a sealing shoulder; a rising piston configured to rise within the upper case and having a lip cosmetic product attached to an upper side of the rising piston; a sealing piston fixedly coupled to an outer side of the rising piston; and an over-cap detachably attached to the lower case, wherein the rising piston is provided on an outer circumference thereof with a sealing ring such that the rising piston rises in a state in which the sealing ring comes into tight contact with an inner circumference of the upper case, and a sealing blade is formed on an outer circumference of the sealing piston such that the sealing blade comes into tight contact with an inner circumference of the sealing shoulder of the upper case, so that the inside of the lip cosmetic case can be doubly sealed by the rising piston and the sealing piston, and thus the sealing capability can be improved.

In addition, according to the airtight lip cosmetic case of which the inside is doubly sealed of the present invention, the sealing piston is formed of a soft synthetic resin material, and the sealing blade extends downward from an upper outer circumference of the sealing piston, such that the sealing blade is gradually inclined outward toward a bottom thereof to elastically come into tight contact with the inner circumference of the upper case, so that external air is prevented from being introduced into the upper case, and thus the lip cosmetic product is prevented from deteriorating or hardening due to the external air.

In addition, according to the airtight lip cosmetic case of which the inside is doubly sealed of the present invention, the first operation member is installed to be vertically movable at the inner side of the lower case, the second operation member engaged with the first operation member by a sawtooth is coupled to the lower side of the upper case, and the elastic member for elastically pushing up the first operation member is installed at the lower side of the first operation member to allow the first operation member, the second operation member, and the upper case to come into tight contact with each other, so that the sealing capability can be maintained while storing or carrying the lip cosmetic case, and thus the lip cosmetic product can be prevented from being exposed to the external air.

BEST MODE

Mode for Invention

The present invention and the technical objects achieved by the implementation of the present invention will be more apparent from the following preferred embodiments. Hereinafter, an airtight lip cosmetic case of which an inside is doubly sealed according to one embodiment of the present invention will be described in detail with reference to the accompanying drawings.

Figure 1:
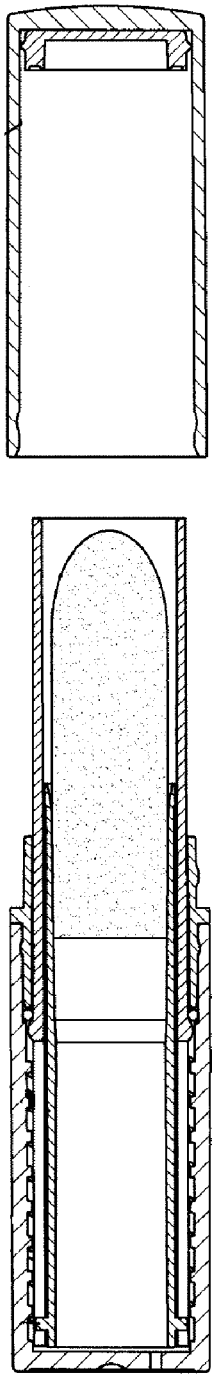
FIG. 1 is a view showing a sealing structure of a conventional lipstick cosmetic container.
Figure 2:
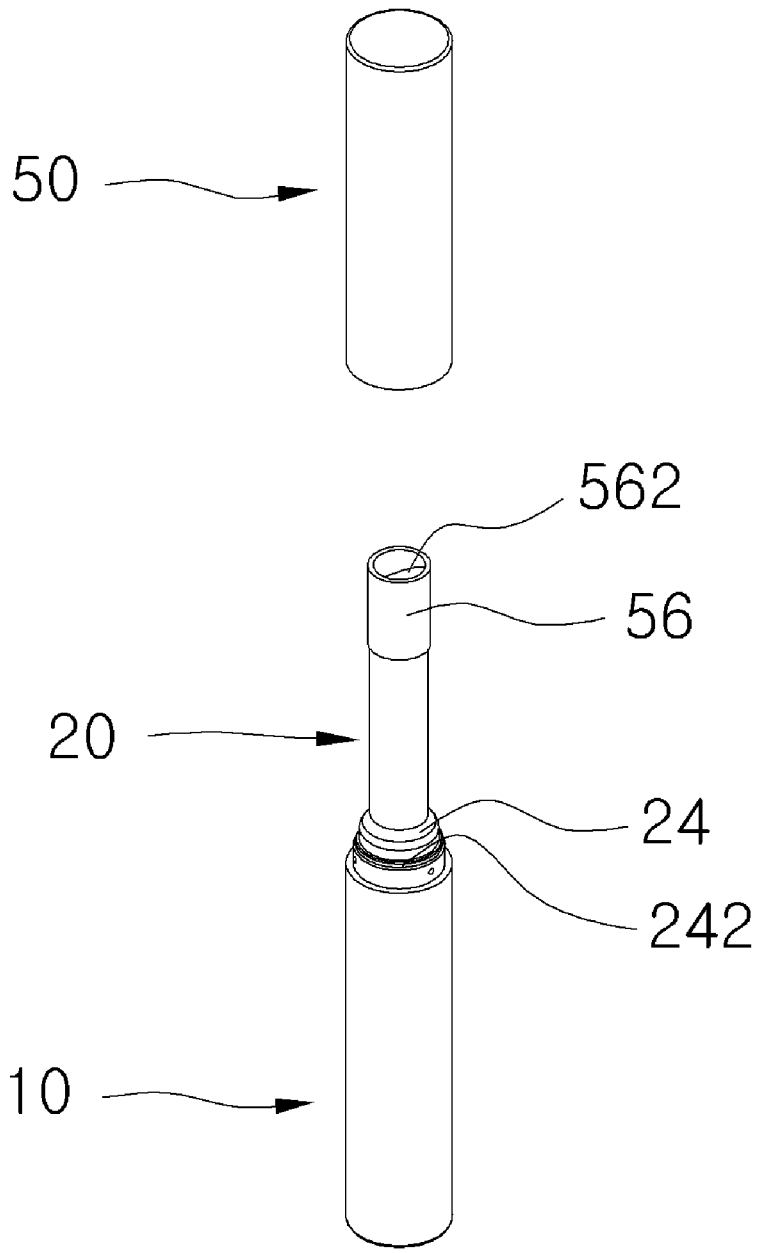
FIG. 2 is a perspective view showing a lip cosmetic case according to one embodiment of the present invention.
Figure 3:
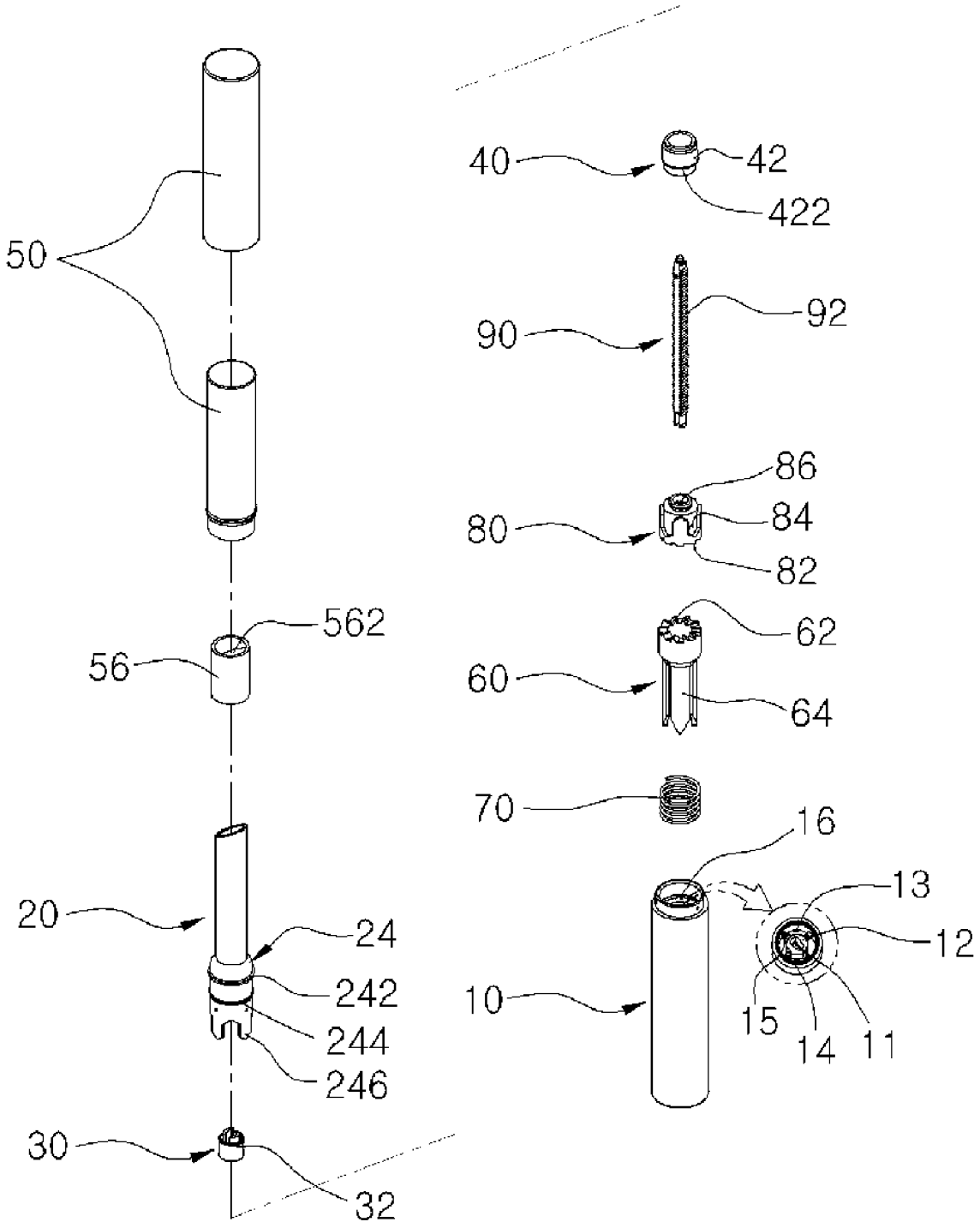
FIG. 3 is an exploded perspective view showing the lip cosmetic case according to one embodiment of the present invention.
Figure 4:
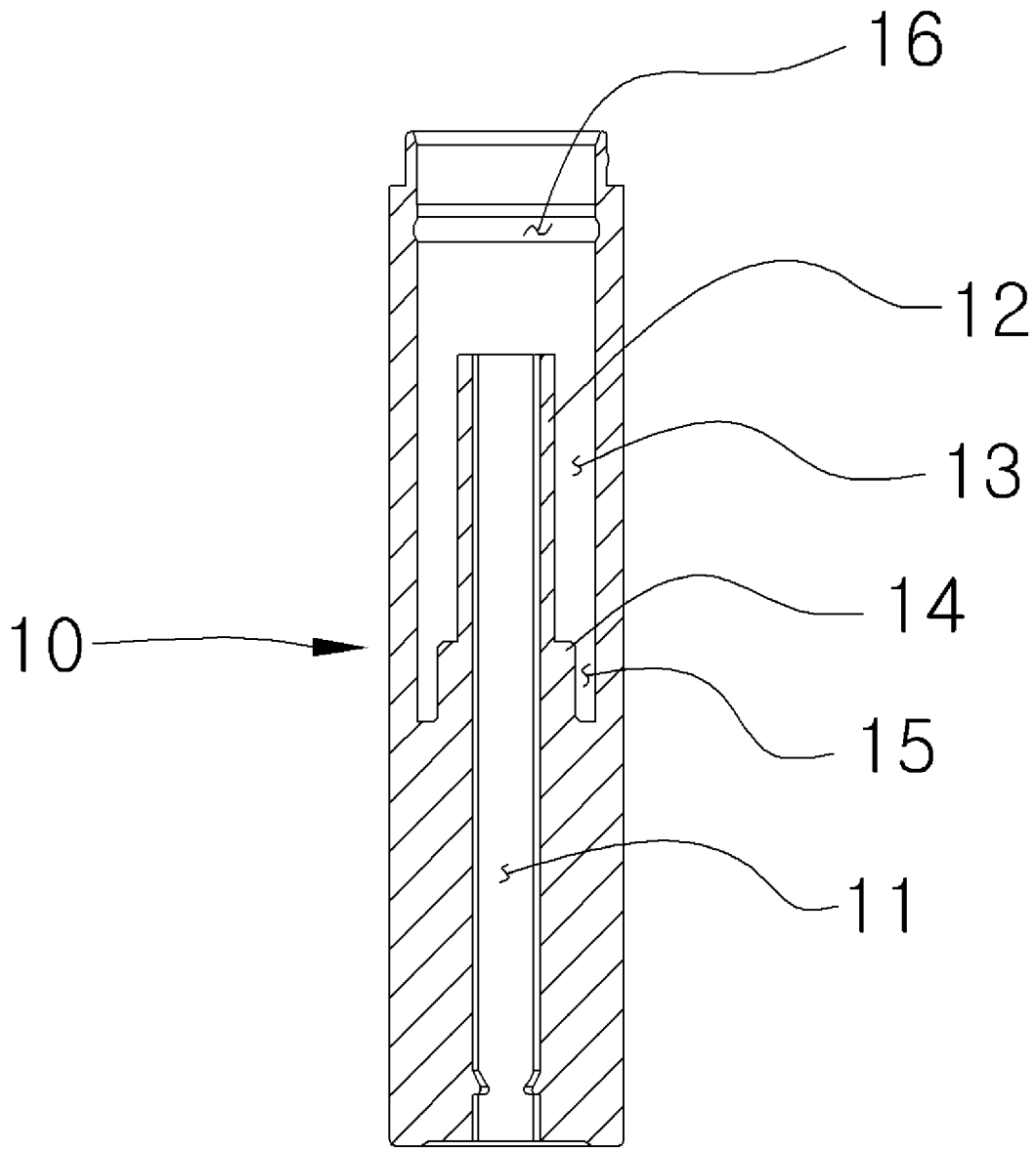
FIG. 4 is a partial sectional view showing the lip cosmetic case according to one embodiment of the present invention.
Figure 5:
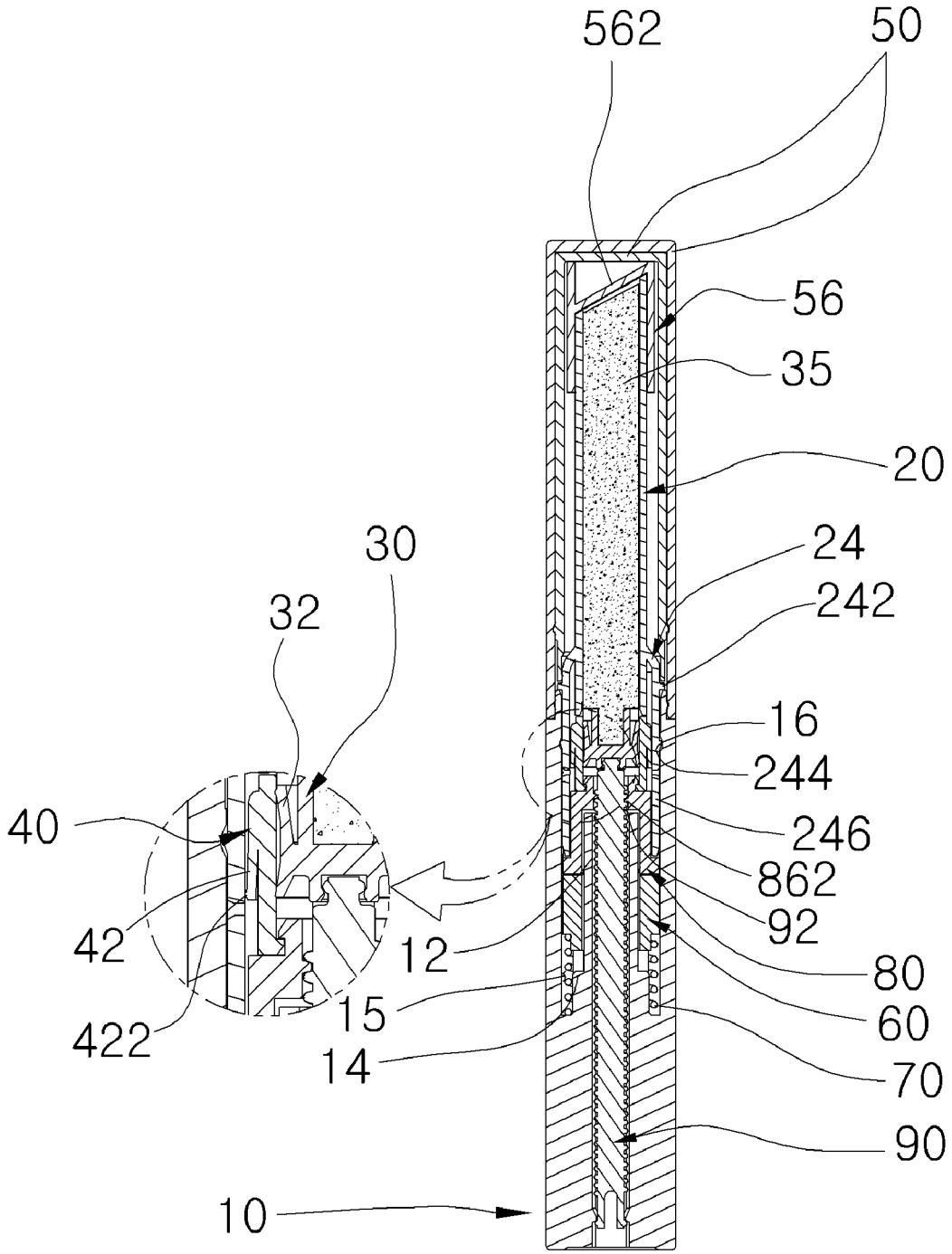
FIG. 5 is a sectional view showing the lip cosmetic case according to one embodiment of the present invention.

FIG. 2 is a perspective view showing a lip cosmetic case according to one embodiment of the present invention, FIG. 3 is an exploded perspective view showing the lip cosmetic case according to one embodiment of the present invention, FIG. 4 is a partial sectional view showing the lip cosmetic case according to one embodiment of the present invention, and FIG. 5 is a sectional view showing the lip cosmetic case according to one embodiment of the present invention.

According to the present invention, the airtight lip cosmetic case of which the inside is doubly sealed, in which a lip cosmetic product 35 inside an upper case 20 rises and protrudes when a lower case 10 rotates, includes: the upper case 20 rotatably coupled to an upper portion of the lower case 10; a rising piston 30 provided in the upper case 20 and having the lip cosmetic product 35 attached to an upper side of the rising piston 30; a sealing piston 40 coupled to an outer side of the rising piston 30 and having a sealing blade 42; and an over-cap 50 for opening and closing the upper case 20, wherein the rising piston 30 rises in a state in which the rising piston 30 comes into tight contact with an inner circumference of the upper case 20, and the sealing blade 42 of the sealing piston 40 comes into tight contact with an inner circumference of the upper case 20.

The lower case 10 has a cylindrical shape with an open top, a lead shaft insertion groove 11 is formed at a center of the lower case 10, and a lead shaft insertion protrusion wheel extends from an outer upper portion of the lead shaft insertion groove 11.

An operation member installation groove 13 in which components of the lip cosmetic case according to the present invention are installed is formed between an inner circumference of the lower case 10 and the lead shaft insertion protrusion wheel 12.

As shown in FIG. 4, a plurality of rotation ribs 14 are formed on an outer side of the lead shaft insertion protrusion wheel 12, and an elastic member installation groove 15 is formed on an outer side of the rotation rib 14.

The lower case 10 is formed at an upper inner circumference thereof with a coupling annular groove 16 to which the upper case 20 is coupled.

The upper case 20 is rotatably coupled to the upper portion of the lower case 10.

The upper case 20 guides a vertical movement of the rising piston 30 provided inside the upper case 20.

A sealing shoulder 24 is formed on a lower outer circumference of the upper case 20, in which the sealing shoulder 24 extends downward from an outer circumference of the upper case 20 while being spaced apart from the outer circumference of the upper case 20 by a predetermined distance.

An upper outer side of the sealing shoulder 24 is preferably curved to allow a lower portion of the over-cap 50 to be smoothly inserted into the upper outer side of the sealing shoulder 24 when the over-cap 50 is coupled to the lower case 10 while covering the upper case 20.

A mount protrusion wheel 242 mounted on an upper end of the lower case 10 protrudes from an outer circumference of the sealing shoulder 24.

A coupling protrusion wheel 244 is formed at a lower side of the mount protrusion wheel 242 of the sealing shoulder 24 and coupled to the coupling annular groove 16 formed in the inner circumference of the lower case 10.

As shown in FIG. 3, a plurality of second fitting portions 246 are formed on a lower portion of the sealing shoulder 24.

A first operation member 60 is installed in the operation member installation groove 13 of the lower case 10, in which the first operation member 60 is coupled to the lower case 10 so as to be vertically movable and rotates together with the lower case 10.

First teeth 62 are formed on an upper end of the first operation member 60, in which the first teeth 62 are inclined only in one direction.

A plurality of first fitting portions 64 are formed on a lower portion of the first operation member 60, in which the first fitting portions 64 are inserted between the rotation ribs 14 formed at an inner side of the lower case 10, so that the first operation member 60 may rotate together with the lower case 10 without idling at the inner side of the lower case 10 when the lower case 10 rotates.

An elastic member 70 for elastically supporting the first operation member 60 is provided at a lower side of the first operation member 60, in which the elastic member 70 is inserted into the elastic member installation groove 15 of the lower case 10.

A second operation member 80 is installed on an upper side of the first operation member 60, in which the second operation member 80 is coupled to the upper case 20.

Second teeth 82 are formed on a lower end of the second operation member 80, in which the second teeth 82 are inclined only in one direction to correspond to the first teeth 62 of the first operation member 60, and engaged with the first teeth 62. In other words, when the user grips and fixes the upper case 20 with one hand and rotates the lower case 10 with the other hand, the second operation member 80 is fixed together with the upper case 20, while the first operation member 60 rotates together with the lower case 10. At this time, inclined surfaces of the second teeth 82 formed on the lower end of the second operation member 80 and the first teeth 62 formed on the upper end of the first operation member 60 come into contact with each other, and the first operation member 60 is elastically supported by the elastic member 70, so that the first teeth 62 of the first operation member 60 elastically pass over the second teeth 82 of the second operation member 80, and thus the first operation member 60 rotates only in one direction with respect to the second operation member 80.

The second operation member 80 is formed in an outer circumference thereof with a plurality of fitting grooves 84 into which the second fitting portions 246 of the upper case 20 are inserted. Accordingly, when the lower case 10 rotates, the second operation member 80 is fixed together with the upper case 20 without rotating along the first operation member 60.

A lead shaft through-hole 86 is formed in a center of the second operation member 80, and an operation screw thread 862 is formed on an outer side of the lead shaft through-hole 86.

As described above, according to the lip cosmetic case of the present invention, the first operation member 60 is installed to be vertically movable at the inner side of the lower case 10, the second operation member 80 engaged with the first operation member 60 is coupled to a lower side of the upper case 20, and the elastic member 70 for elastically pushing up the first operation member 60 is installed at the lower side of the first operation member 60 to allow the first operation member 60, the second operation member 80, and the upper case 20 to come into tight contact with each other.

Accordingly, sealing capability is maintained while storing or carrying the lip cosmetic case, so that the lip cosmetic product is prevented from being exposed to external air.

A lead shaft 90, which rises while passing through the first operation member 60 and the second operation member 80, is coupled to an inner side of the lead shaft insertion protrusion wheel 12 of the lower case 10.

The rising piston 40 is coupled to an upper end of the lead shaft 90, and a lead shaft screw thread 92 is formed on an outer circumference of the lead shaft 90 so as to be screw-coupled to the operation screw thread 862 of the second operation member 80.

The rising piston 30 rises within the upper case 20 by the lead shaft 90, and the lip cosmetic product 35 is attached to the upper side of the rising piston 30.

A sealing ring 32 is formed on the outer side of the rising piston 30, in which the rising piston 30 rises in a state in which the sealing ring 32 comes into tight contact with the inner circumference of the upper case 20. Accordingly, the lip cosmetic product 35 is prevented from deteriorating or hardening due to contact between the lip cosmetic product 35 and the external air which is introduced into a lower side of the rising piston 30 through the lower case 10.

A fixed piston 40 is fixedly coupled to an inner side of the sealing shoulder 24 of the upper case 20, such that an upper end of the fixed piston 40 comes into tight contact with a lower end of the upper case 20, and a lower end of the fixed piston 40 is fixedly coupled to an upper portion of the second operation member 80.

The fixed piston 40 is formed on an outer circumference thereof with the sealing blade 42.

The sealing blade 42 extends downward from an upper outer circumference of the sealing piston 40, such that the sealing blade 42 is gradually inclined outward toward a bottom thereof to elastically come into tight contact with the inner circumference of the upper case 20, so that the sealing capability of the lip cosmetic case is improved.

In other words, according to the lip cosmetic case of the present invention, as shown in FIG. 5, the sealing blade 42 is formed on the outer circumference of the sealing piston 40 such that the sealing blade 42 is fixed in a state in which the sealing blade 42 comes into tight contact with an inner circumference of the sealing shoulder 24 of the upper case 20, so that the inside of the lip cosmetic case is primarily sealed. In addition, the rising piston 30 is provided on an outer circumference thereof with the sealing ring 32 such that the rising piston 30 rises in a state in which the sealing ring 32 comes into tight contact with an inner circumference of the upper case 20, so that the inside of the lip cosmetic case is secondarily sealed.

Therefore, the inside of the lip cosmetic case is doubly sealed by the rising piston 30 and the sealing piston 40, so that the sealing capability is improved.

A sealing protrusion wheel 422 is formed on a lower outer circumference of the sealing blade 42 and comes into tight contact with the inner circumference of the sealing shoulder 24 of the upper case 20.

The sealing piston 40 is preferably formed of a soft synthetic resin material so as to be elastically bent.

The over-cap 50 is coupled to the lower case 20 while surrounding the upper case 20 so as to open and close the upper case 20.

An inner cap 56 is further provided on an upper side of the upper case 20 to improve the sealing capability of the lip cosmetic case.

The inner cap 56 is coupled to an upper portion of the upper case 20 while surrounding the upper portion of the upper case 20, and an upper end of the inner cap 56 is pressed by the over-cap 50 when the over-cap 50 is coupled to the lower case 10.

A blocking plate 562 is formed at an upper inner side of the inner cap 56, in which the blocking plate 562 is inclined in one direction and comes into tight contact with an upper end of the upper case 20.

Hereinafter, a method of assembling the airtight lip cosmetic case of which the inside is doubly sealed, which has a configuration as described above, will be described with reference to the accompanying drawings.

To assemble the airtight lip cosmetic case of which the inside is doubly sealed according to the present invention, as shown in FIGS. 3 to 5, the elastic member 70 and the first operation member 60 are installed at the inner side of the lower case 10, such that the elastic member 70 is inserted into the elastic member installation groove 15 of the lower case 10, and the first fitting portions 64 of the first operation member 60 are inserted between the rotation ribs 14 of the lower case 10.

Next, after the second operation member 80 is screw-coupled to the lead shaft 90, the lead shaft 90 and the second operation member 80 are coupled to the operation member installation groove 13 of the lower case 10, such that the lead shaft 90 is inserted into the lead shaft insertion protrusion wheel 12 of the lower case 10, and the second teeth 82 of the second operation member 80 are engaged with the first teeth 62 of the first operation member 60.

Next, after the inner cap 56 is coupled to the upper side of the upper case 20, the upper case 20 is turned upside down, contents of the lip cosmetic product 35 are injected from the lower side of the upper case 20, the rising piston 30 is coupled to the lower side of the upper case 20, and the contents of the lip cosmetic product 35 are solidified.

Next, the fixed piston 40 is inserted into the lower case 10 and coupled to the upper portion of the second operation member 80, and the upper case 20 assembled as described above is coupled to the upper portion of the lower case 10, such that the coupling protrusion wheel 244 of the upper case 20 is coupled to the coupling annular groove 16 of the lower case 10 while the rising piston 30 is coupled to an upper portion of the lead shaft 90.

At this time, the sealing blade 42 formed on an outer circumference of the fixed piston 40 elastically comes into tight contact with the inner circumference of the sealing shoulder 24 of the upper case 20, so that the sealing capability of the inside of the lip cosmetic case is improved.

Finally, the over-cap 50 is coupled to the upper portion of the lower case 10, so that the assembly of the airtight lip cosmetic case of which the inside is doubly sealed according to the present invention is completed.

Hereinafter, the use of the airtight lip cosmetic case of which the inside is doubly sealed, which is assembled as described above, will be described with reference to the accompanying drawings.

Figure 6:
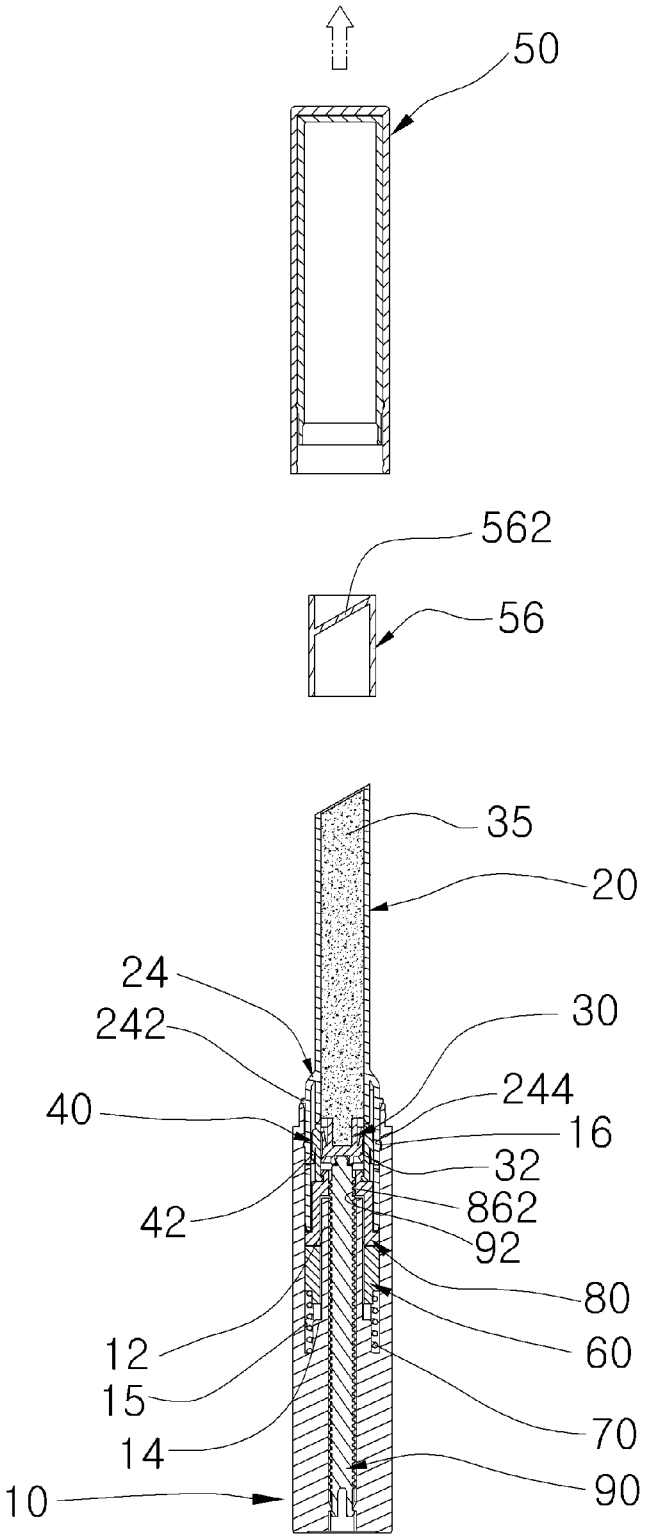
FIG. 6 is a sectional view showing a state in which an over-cap is separated from an inner cap of the lip cosmetic case according to one embodiment of the present invention.
Figure 7:
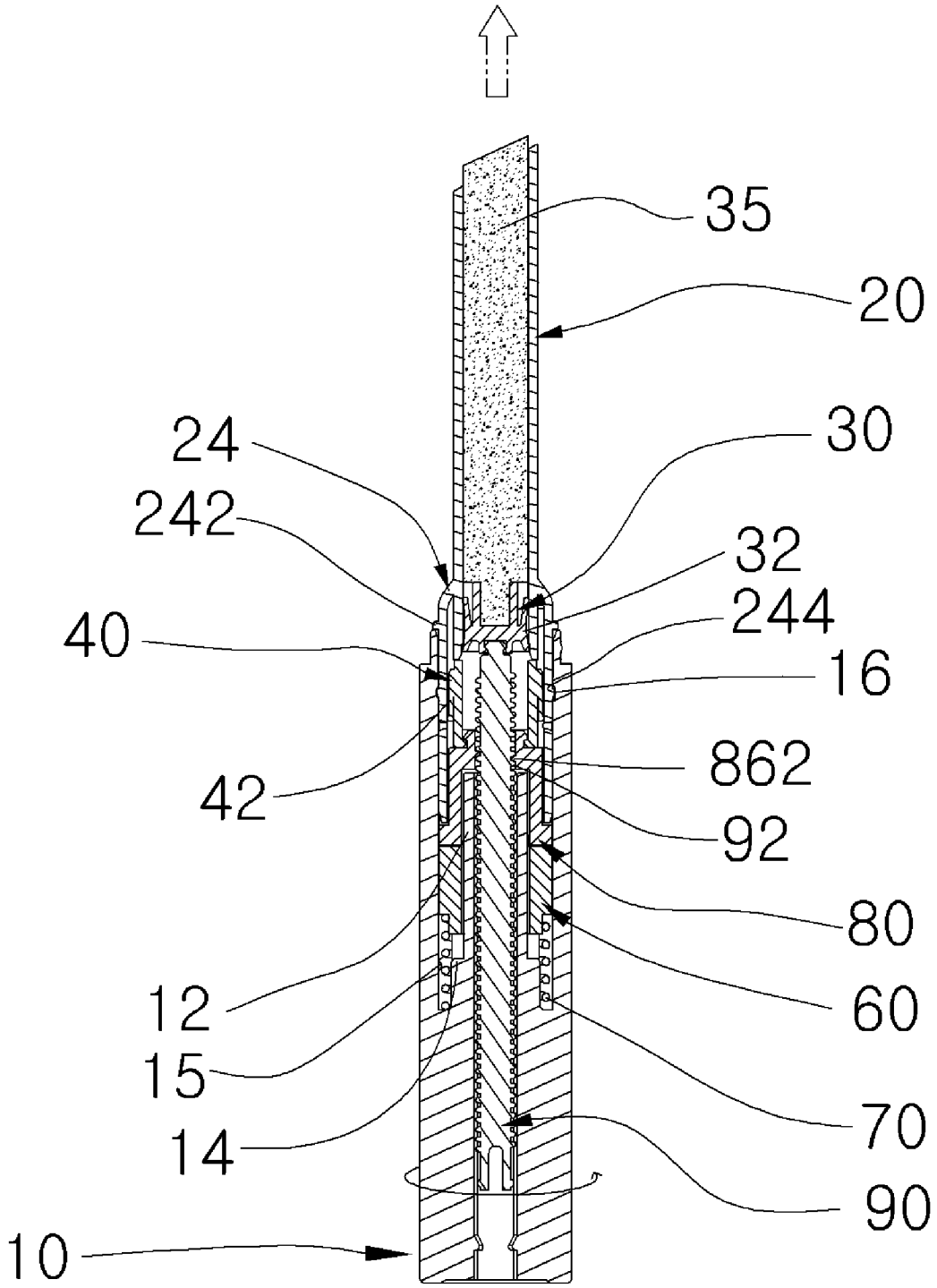
FIG. 7 is a sectional view showing a state in which a lip cosmetic product protrudes by rotating a lower case of the lip cosmetic case according to one embodiment of the present invention.
Figure 8:
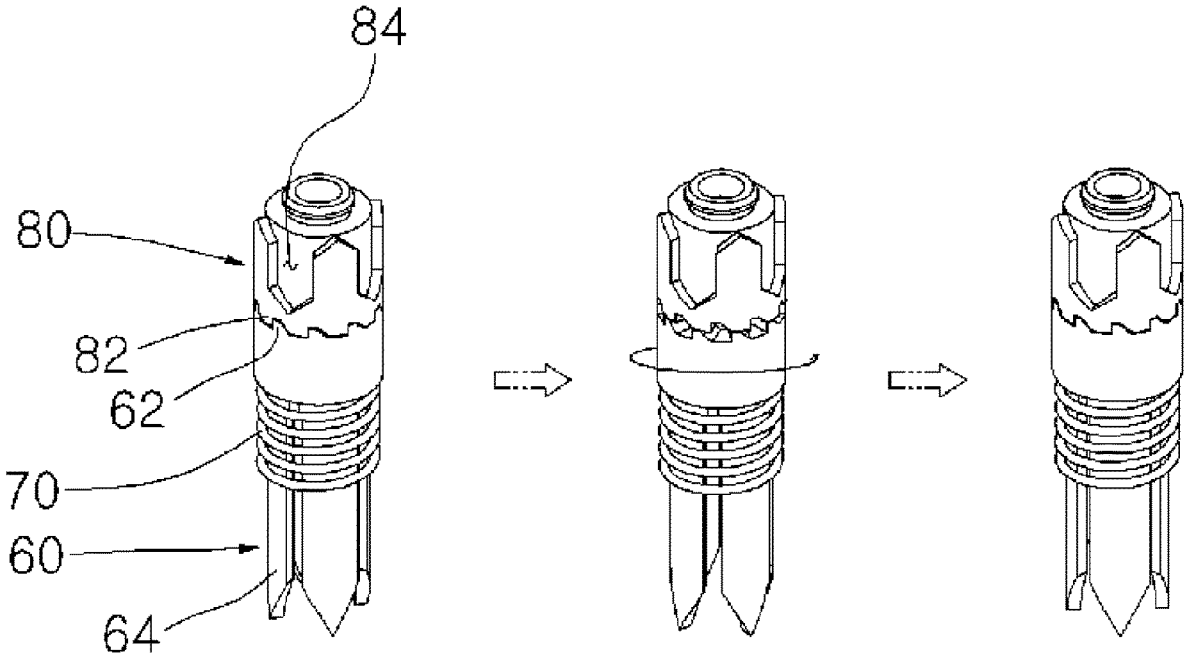
FIG. 8 is a partial perspective view showing states of rotating a first operation member of the lip cosmetic case according to one embodiment of the present invention.
Figure 9:
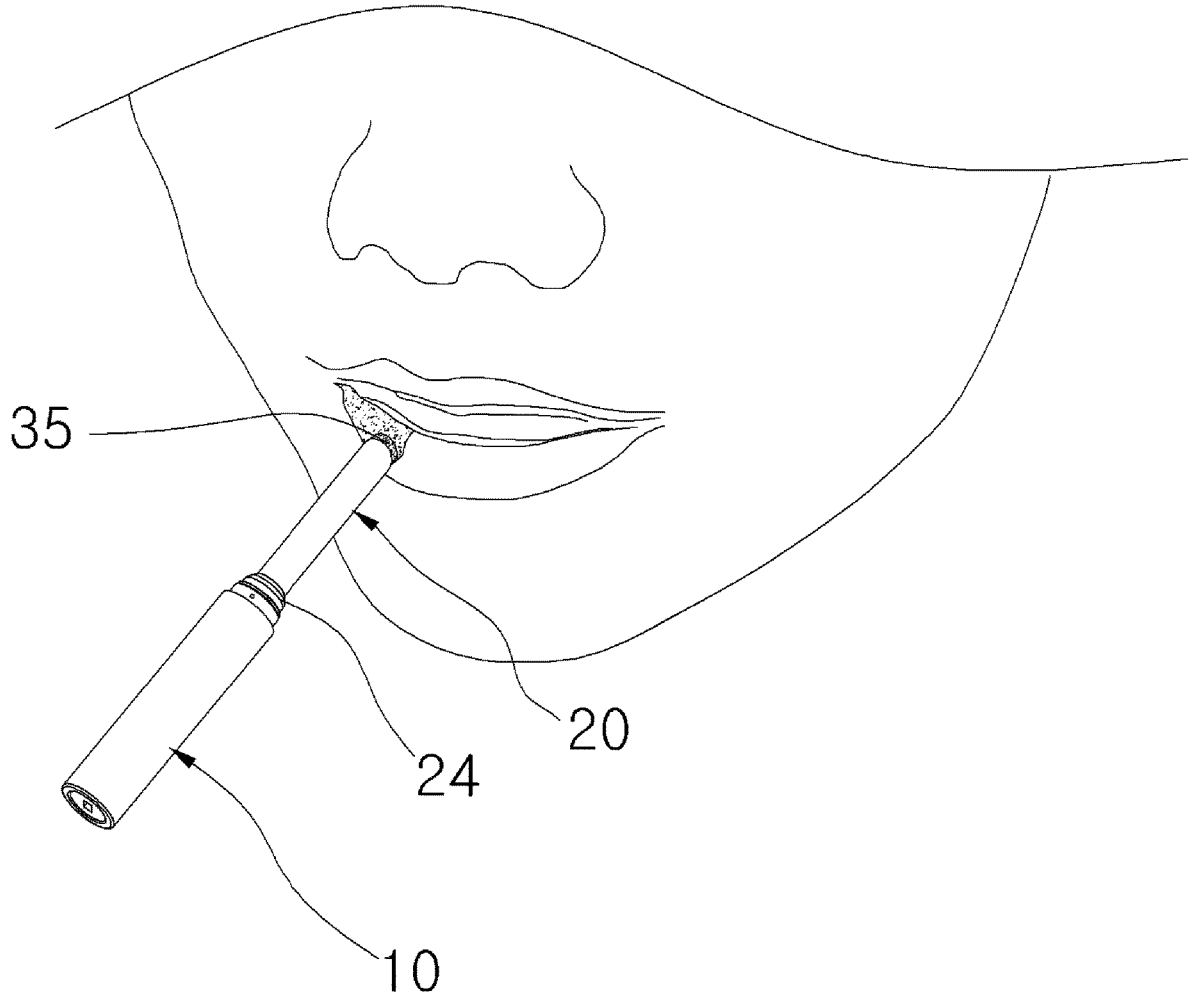
FIG. 9 is a perspective view showing a state in which a user performs makeup with the lip cosmetic product protruding from the lip cosmetic case according to one embodiment of the present invention.

FIG. 6 is a sectional view showing a state in which an over-cap is separated from an inner cap of the lip cosmetic case according to one embodiment of the present invention, FIG. 7 is a sectional view showing a state in which a lip cosmetic product protrudes by rotating a lower case of the lip cosmetic case according to one embodiment of the present invention, FIG. 8 is a partial perspective view showing states of rotating a first operation member of the lip cosmetic case according to one embodiment of the present invention, and FIG. 9 is a perspective view showing a state in which a user performs makeup with the lip cosmetic product protruding from the lip cosmetic case according to one embodiment of the present invention.

To use the airtight lip cosmetic case of which the inside is doubly sealed according to the present invention, first, as shown in FIG. 6, the over-cap 50 and the inner cap 56 are sequentially separated from the lower case 10.

Then, as shown in FIG. 7, the upper case 20 is gripped and fixed by one hand, and the lower case 10 is rotated in one direction by the other hand, so that the first operation member 60 is rotated with respect to the second operation member 80.

In more detail, in a rotation process of the first operation member 60, as shown in FIG. 8, the inclined surfaces of the first teeth 62 formed on the upper end of the first operation member 60 come into contact with the second teeth 82 formed on the lower end of the second operation member 80. When the user rotates the lower case 10, the second operation member 80 is fixed by the upper case 20, while the first operation member 80 rotates together with the lower case 10.

At this time, the first operation member 60 is elastically supported by the elastic member 70, so that the first operation member 60 rotates such that the first teeth 62 of the first operation member 60 elastically pass over the second teeth 82 of the second operation member 80.

At the same time, the lead shaft 90 provided inside the lower case 10 also rotates together, in which the lead shaft 90 gradually rises while rotating because the lead shaft 90 is screw-coupled to the second operation member 80 fixed to the upper case 20.

Accordingly, the rising piston 30 coupled to the upper portion of the lead shaft 90 rises in a state in which the rising piston 30 comes into tight contact with the inner circumference of the upper case 20, and the lip cosmetic product 35 attached to an upper portion of the rising piston 30 also rises, so that an upper portion of the lip cosmetic product 35 is exposed to the upper side of the upper case 20.

Then, as shown in FIG. 9, the lip makeup is performed using the lip cosmetic product 35 exposed to an outside.

After the makeup is completed, the inner cap 56 and the over-cap 50 are coupled to the lower case 10 to store or carry the lip cosmetic case.

As described above, although the airtight lip cosmetic case of which the inside is doubly sealed according to one embodiment of the present invention has been described for illustrative purposes, the present invention is not limited thereto. It is understood that various changes and modifications can be made by those skilled in the art without departing from the spirit and scope of the present invention as disclosed in the appended claims.

[Description of Reference Numerals]

| | |
|---|---|
| 10: Lower case | 20: Upper case |
| 24: Sealing shoulder | 30: Rising piston |

-continued

[Description of Reference Numerals]

| | |
|---|---|
| 32: Sealing ring | 35: Lip cosmetic product |
| 40: Fixed piston | 42: Sealing blade |
| 50: Over-cap | 60: First operation member |
| 70: Elastic member | 80: Second operation member |
| 90: Lead shaft | 422: Sealing protrusion wheel |

The invention claimed is:

1. An airtight lip cosmetic case of which an inside is doubly sealed, in which a lip cosmetic product inside an upper case rises and protrudes when a lower case rotates, the airtight lip cosmetic case comprising:

the upper case rotatably coupled to an upper portion of the lower case, the upper case including a sealing shoulder formed on a lower outer circumference thereof;

a rising piston provided in the upper case and having the lip cosmetic product attached to an upper side of the rising piston;

a sealing piston coupled to an outer side of the rising piston and an inner side of the sealing shoulder of the upper case and having a sealing blade that extends downward from an upper outer circumference of the sealing piston; and an over-cap for opening and closing the upper case, wherein the rising piston rises in a state in which the rising piston comes into tight contact with an inner circumference of the upper case, and the sealing blade of the sealing piston comes into tight contact with an inner circumference of the sealing shoulder of the upper case, wherein the sealing shoulder extends downward from an outer circumference of the upper case while being spaced apart from the outer circumference of the upper case by a predetermined distance, and an upper side of the sealing shoulder is curved, and wherein the sealing blade is gradually inclined outward toward a bottom of the sealing piston to elastically come into tight contact with the inner circumference of the upper case.

2. The airtight lip cosmetic case of claim 1, wherein a first operation member which is vertically movable, a second operation member engaged with an upper portion of the first operation member, and an elastic member for elastically pushing up the first operation member are coupled in the lower case.

3. The airtight lip cosmetic case of claim 1, wherein the rising piston is provided on an outer side thereof with a sealing ring.

4. The airtight lip cosmetic case of claim 1, wherein a sealing protrusion wheel is formed on a lower outer circumference of the sealing blade of the sealing piston and comes into tight contact with the inner circumference of the upper case.

5. The airtight lip cosmetic case of claim 1, wherein the sealing piston is formed of a soft synthetic resin material.

* * * * *